US005105957A

United States Patent [19]

Männl

[11] Patent Number: 5,105,957

[45] Date of Patent: Apr. 21, 1992

[54] HEAT-SEALABLE GLASS CONTAINER

[75] Inventor: Reinhard Männl, Mitterteich, Fed. Rep. of Germany

[73] Assignee: Schott-Ruhrglas GmbH, Bayreuth, Fed. Rep. of Germany

[21] Appl. No.: 331,321

[22] Filed: Mar. 31, 1989

[30] Foreign Application Priority Data

Mar. 31, 1988 [DE] Fed. Rep. of Germany ..... 3810939

[51] Int. Cl.[5] ..... B65D 1/00; B65D 65/38; B65D 85/50

[52] U.S. Cl. ..... 215/32; 215/12.2; 215/31

[58] Field of Search ..... 215/1 R, 1 C, 31, 32, 215/DIG. 6, 12.2; 501/59, 66, 74, 60, 70

[56] References Cited

U.S. PATENT DOCUMENTS

| | | | |
|---|---|---|---|
| 2,517,604 | 8/1950 | Smith | 215/32 |
| 3,535,070 | 10/1970 | Francel et al. | 215/32 |
| 3,672,919 | 6/1972 | Sack | 501/59 |
| 3,949,335 | 4/1976 | Morgan | 501/60 X |
| 3,961,970 | 6/1976 | Morgan | 501/70 X |
| 4,001,741 | 1/1977 | Lindig et al. | 501/59 X |
| 4,156,626 | 5/1979 | Souder | 156/272 |
| 4,277,285 | 7/1981 | Boudot et al. | 501/74 |
| 4,315,054 | 2/1982 | Sack et al. | 252/62.55 X |
| 4,826,025 | 5/1989 | Abiko et al. | 215/32 X |

FOREIGN PATENT DOCUMENTS

| | | |
|---|---|---|
| 473289 | 7/1947 | Belgium . |
| 244746 | 11/1987 | European Pat. Off. . |
| 845564 | 8/1952 | Fed. Rep. of Germany . |
| 1105560 | 4/1961 | Fed. Rep. of Germany . |
| 2819767 | 11/1978 | Fed. Rep. of Germany . |
| 8601774 | 6/1986 | Fed. Rep. of Germany . |
| 1549511 | 11/1968 | France . |
| 52-147617 | 12/1977 | Japan . |
| 6510316 | 2/1967 | Netherlands . |

*Primary Examiner*—Sue A. Weaver
*Attorney, Agent, or Firm*—Millen, White & Zelano

[57] ABSTRACT

A glass container for biological materials is provided which can be hermetically sealed. The open end of the container is formed of an infrared-absorbing glass which can be heat-sealed with an infrared lamp.

29 Claims, 1 Drawing Sheet

HEAT-SEALABLE GLASS CONTAINER

CROSS-REFERENCE TO RELATED APPLICATIONS

This application is related to a concurrently filed application entitled "Apparatus and Process for Heat-Sealing a Glass Container", based on German priority document P 38 10 940.9, U.S. Pat. application Ser. No. 07/331,284, now U.S. Pat. No. 4,981,505, issued Jan. 1, 1991.

BACKGROUND OF THE INVENTION

This invention relates in general to heat-sealable containers and, more particularly, to glass containers for biological materials which can be hermetically sealed with infrared radiation.

The storage of biological materials in glass containers presents special problems because of the danger of the escape of contagious biological materials, i.e., bacteria and viruses, as well as the danger that continued exposure to air will have a harmful effect on the biological material. For these reasons, it is desirable to form an airtight seal on such containers. Heat-sealing of these containers has been found to be a suitable procedure for forming an hermetic seal only in the limited instances where the high temperatures associated with heat-sealing do not damage the biological material.

These containers have been made of types of glass which are resistant to attack by biological materials and do not contaminate the biological materials. Heretofore, the only glasses known to have the necessary compatibility with biological materials had relatively high melting points. Consequently, in heat-sealing such glass containers, it was necessary to heat the container to a high temperature with, for example, a glass blower's burner in order to melt closed the open end of the container. In most cases where the biological material is to be stored only temporarily before being tested, the conventional heat-sealing process is unsatisfactory because the high temperatures needed to seal the container often damage or result in the destruction of the biological material. Another disadvantage of this procedure is the need for skilled personnel to ensure that the container is completely closed to form an airtight seal. It is desired to have a heat-sealable glass container for biological samples which can be hermetically sealed without deleteriously affecting the biological materials therein. Heretofore, infrared-absorbing glass had not been employed to store biological samples due to its higher cost and its tendency to interact with and/or contaminate the biological material.

SUMMARY OF THE INVENTION

It is therefore an object of the present invention to provide a heat-sealable glass container suitable for perishable biological specimens that are collected in a physician's office or medical clinic for transfer to a testing laboratory.

Upon further study of the specification and appended claims, further objects and advantages of the invention will become apparent to those skilled in the art.

These objects are attained according to the invention by fabricating at least the open-end portion of the glass containers from an infrared-absorbing glass generally having an infrared absorbance of at least 10 $cm^{-1}$ and preferably at least 25 $cm^{-1}$ (in the wavelength region above 0.7 um wavelength and preferably in the near infrared (0.76 to 2.5 um)), and a melting point generally not greater than about 1,250° C., and preferably less than 1,000° C. Preferably, the body of the glass containers is transparent and may be of colored transparent glass. The transparency permits the visual control of the content of the glass. The infrared-absorbing glass is generally blue or blue-green colored.

In a preferred embodiment, the infrared-absorbing glasses used herein can be worked, i.e., drawn and melted closed, when heated by an incandescent or infrared light source to a temperature of from about 950° C. to 1,000° C. The use of such lower melting point glass eliminates the need for an open flame and the attendant risk of damaging the biological sample. It also eliminates the need for highly skilled personnel to close the container with a burner. Since a large part of the energy emanating from the incandescent or infrared lamp used as the heat source is in the near infrared region of the spectrum (i.e., a wavelength of 760 to 2,500 nanometers), it is preferred to form the container from a glass which has a maximum absorbance of radiation in the same region of the spectrum. Matching the spectral output of the heat source with the absorption characteristics of the glass results in the efficient utilization of energy and a more rapid heating of the heat-sealable portion of the container. For example, infrared-absorbing glasses having a maximum absorbance between 1 um and 1.2 um of at least 80% (at a thickness of 0.5 mm) are suitable for use with an infrared lamp having an emission from 500 to 2,000 nm and a maximum emission at 800 nm.

The preferred glasses which are suitable for use herein are described in U.S. Pat. Ser. No. 4,315,054, 4,277,285, 4,001,741, 3,961,970, 3,949,335 and DE-PS 21 16 155. Other suitable glasses contain (in wt. %) $SiO_2$ 65–75 (70), $B_2O_3$ 0–3 (1), $Al_2O_3$ 1–5 (3.5), $Li_2O$ 0–2 (1), $Na_2O$ 5–12 (9.5), $K_2O$ 2–6 (4), BaO 5–10 (7), $Fe_3O_4$ 2–5 (3.5) and F 0–2 (0.5). The values in parentheses indicate a preferred composition. The $Fe_3O_4$ content of all these glasses can be reduced wholly or in part to FeO with the aid of e.g. a sugar.

In a preferred embodiment, the entire heat-sealable container is formed of the above-described glass which absorbs radiation in the infrared region of the spectrum. In another embodiment, only the heat-sealable end portion of the container is formed of an infrared-absorbing glass. In such cases, the open-end portion is heat-sealed to the body of the container which may be formed of any conventional glass used in fabricating containers for biological samples.

In another embodiment, the heat-sealable container has a breakaway area which can easily be ruptured for removal of the contents of the container without shattering the surrounding portions of the container. The breakaway area is preferably marked along its boundaries or at its center to facilitate the visual identification of the area to be ruptured.

BRIEF DESCRIPTION OF THE DRAWINGS

The invention and the further details of the invention will become more apparent from examples of the embodiment presented hereinafter and illustrated in the drawings.

FIG. 1 also shows the energy source used to heat-seal the container.

DETAILED DESCRIPTION OF THE DRAWINGS

Figure 1:
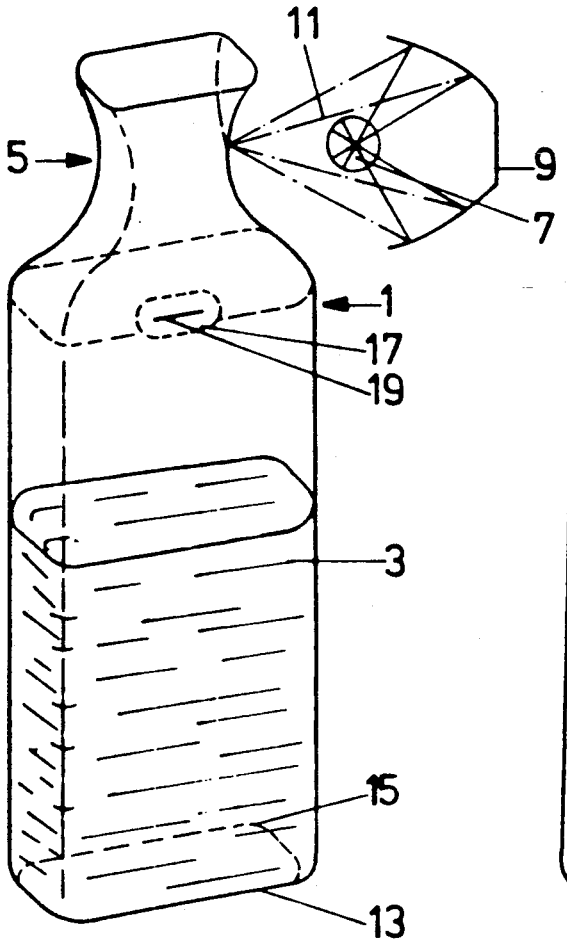
FIG. 1 is a perspective view of the container according to the invention before it is heat-sealed.

FIG. 1 shows a heat-sealable container 1 of glass which is partially filled with a biological material 3. Container 1 preferably has a tapered heat-sealable end portion or neck 5 formed of a glass which absorbs radiation in the infrared region of the spectrum. The remaining body portion of the container may be formed of any type of glass conventionally used as a container for biological samples. The body portion may also be formed of the same glass from which the neck portion 5 is formed. The heat-sealable neck 5 can easily be sealed by focusing the light from an incandescent or infrared lamp onto the neck portion. FIG. 1 illustrates such an arrangement in which infrared lamp 7 is provided with an elliptical reflector 9 to focus the infrared energy from lamp 7 onto the heat-sealable neck 5 of the container. When container 1 is made of two different types of glass, the two different sections of the container are fused together at elevated temperatures.

In a preferred embodiment, the neck portion 5 is formed of glass No. 8516 manufactured by Schott Glaswerke, Mainz, Federal Republic of Germany. This glass is composed of (in wt. %) $SiO_2$ 70, $B_2O_3$ 1, $Al_2O_3$ 3.5, $Li_2O$ 1, $Na_2O$ 9.5, $K_2O$ 4, BaO 7, $Fe_3O_4$ 3.5, F 0.5. FeO produces the infrared absorption, the amount of FeO in $Fe_3O_4$ can be varied using a reducing agent, e.g. sugar, in the glass melt.

The neck portion 5 may, however, be formed of other glasses which absorb energy in the infrared region of the spectrum and have a low working temperature, as discussed above.

The container shown in FIG. 1 is designed to handle a sample of a biological material 3. Although the container may be of any shape, the container 1 is shown with an out-of-round cross-section and two opposing, substantially parallel side walls 13 and 15. Such containers can advantageously be used when optical tests are to be performed and it is desired to avoid removing the material from the container for such tests.

Spaced from the heat-sealable neck 5 is at least one breakaway area 17. The breakaway area is simply a weakened area of the glass. The glass may be weakened by scratching, etching, or other known methods. In a preferred embodiment, the breakaway area 17 is formed by localized heating of the container to prestress the glass in the breakaway area. The container 1 has at least one marking 19 which indicates the location of the breakaway area. Advantageously, a dotted or continuous line may be applied to the container to identify the boundaries of the breakaway area. In order to identify the location of the heat-sealable portion of the container, neck 5 may be constricted or tapered as shown in FIG. 1.

Figure 2:
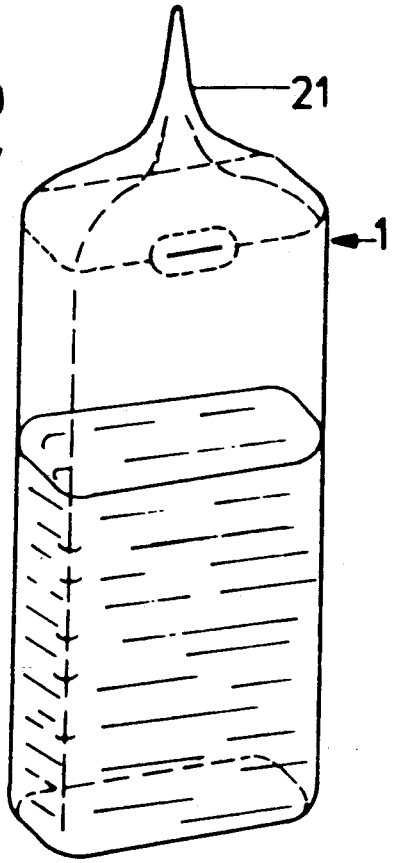
FIG. 2 is a perspective view of the container of FIG. 1 after it has been sealed.

FIG. 2 shows the container 1 after it has been heat-sealed. The heat-sealed tip is fused closed to form a complete hermetic seal.

Figure 3:
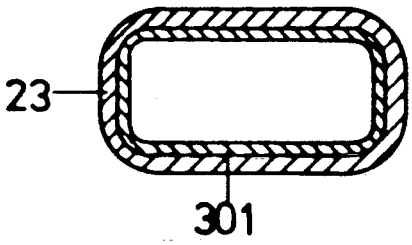
FIG. 3 is a cross-sectional view of the glass container of FIG. 1, which has an outer coating thereon.

FIG. 3 shows another embodiment in which a heat-sealable container constructed according to the invention described herein is sheathed with a continuous outer plastic coating 23. This plastic coating prevents the escape of biological materials should the container be accidentally broken. It is desirable to use a plastic coating upon which written instructions can be inscribed or printed. Suitable plastics which can be used as the outer coating include but are not limited to Lewasint PE from Bayer, Leverkinen, Federal Republic of Germany, which is an ethylene-vinyl alcohol-copolymer. The neck portion 5 is left uncovered with said plastic coating because the coating would catch fire.

In general, the preferred dimensions of the glass container of this invention are: tube-shaped, diameter 8 to 25 mm, high 50 to 180 mm, glass thickness 0.3 to 1.5 mm, preferably 0.8 to 1.2 mm, volume 5 to 50 ml. If the container is rectangular in cross-section, the sides of the container are parallel and the area of cross-section is 0.5 to 5 $cm^2$ whereat the aspect ratio is 1:1 to 1:3, preferably 1:1. Generally, the upper portion of the container which is to be heat-sealed has about the same glass thickness as the main body of the glass.

In the context of the present invention, infrared absorbance is defined as $$I_d = I_{o'e} - k.d$$

$I_d$ = intensity after passing through the thickness of the glass whose absorption coefficient is k $I_o$ = original intensity e = Euler's constant (2.718...)

k = infrared absorbance (absorption coefficient).

Preferably, the neck portion is sealed with a halogen infrared emission reflector No. 64635 manufactured by Osram, Berlin, Federal Republic of Germany. This lamp has the following characteristics: maximum intensity at 800 nm, wavelength region 500 to 2,000 nm, power 150 W, maximum temperature in the focal point 1,500° C.

The container may be heat-sealed by using the apparatus and/or process described in the cross-referenced concurrently filed application now U.S. Pat. No. 4,981,505, issued Jan. 1, 1991, entitled "Apparatus and Process for Heat-Sealing a Glass Container" by Reinhard Männl.

The entire texts of all applications, patents and publications, if any, cited above and below, and of corresponding application P 38 10 939.5 filed Mar. 31, 1988 in the Federal Republic of Germany, are hereby incorporated by reference.

From the foregoing description, one skilled in the art can easily ascertain the essential characteristics of the invention and, without departing from the spirit and scope thereof, can make various changes and modifications of the invention to adapt it to various usages and conditions.

We claim:

1. A heat-sealable glass container having an open-end portion, said open-end portion being formed of an infrared-absorbing glass which has an infrared absorbance of at least 10 $cm^{-1}$ in the wavelength region above 0.7 micron wavelength.

2. The heat-sealable glass container of claim 1, wherein the entire container is formed of the infrared-absorbing glass.

3. The heat-sealable glass container of claim 1, wherein the open-end portion of the container is formed from a glass comprising essentially: $SiO_2$ 65–75 wt. %, $B_2O_3$ 0–3 wt. %, $Al_2O_3$ 1–5 wt. %, $Li_2O$ 0–2 wt. %, $Na_2O$ 5–12 wt. %, $K_2O$ 2–6 wt. %, BaO 5–10 wt. %, $Fe_3O_4$ 2–5 wt. %, F 0–2 wt. % and a reducing agent.

4. The heat-sealable glass container of claim 3, wherein the open-end portion has been heated and drawn to a point, thereby to hermetically seal the container.

5. A hermetically heat-sealed container formed of the container of claim 3.

6. The heat-sealable glass container of claim 1, wherein the open-end portion is formed of glass which absorbs light in the near infrared spectrum and has an absorbance of at least 10 $cm^{-1}$ in the near infrared spectrum.

7. A hermetically heat-sealed container formed of the container of claim 6.

8. The heat-sealable glass container of claim 1, wherein said open-end portion is formed of a glass which when heated to a temperature of from about 950 to 1,000° C. softens enough to be drawn and hermetically sealed.

9. The heat-sealable glass container of claim 1, wherein the open-end portion is tapered.

10. The heat-sealable glass container of claim 1, wherein other portions of the glass container are formed of glass which has an absorbance in the infrared region of the spectrum of less than 2 $cm^{-1}$.

11. The heat-sealable glass container of claim 10, wherein said open-end portion has been heat-sealed to a portion of the glass container having an abosrbance in the infrared region of the spectrum of less than 2 $cm^{-1}$.

12. The heat-sealable glass container of claim 1, wherein spaced from said open-end portion is a breakaway area which can easily be ruptured.

13. The heat-sealable glass container of claim 12, wherein the breakaway area is formed by localized heating of said area to prestress the glass only in the breakaway area.

14. The heat-sealable glass container of claim 12, wherein the breakaway area is marked for visual identification.

15. The heat-sealable glass container of claim 1, wherein the glass container has an exterior coating of a plastic material.

16. The heat-sealable glass container of claim 1, in which the open-end portion has been heated and drawn to a point, thereby to hermetically seal the container.

17. A glass container according to claim 1 having a glass thickness of 0.3 to 1.5 mm.

18. A glass container according to claim 17 having a tubular shape, a diameter of 8 to 25 mm, a height of 50 to 180 mm, and a volume of 5 to 50 ml.

19. A hermetically heat-sealed container formed of the container of claim 18.

20. A glass container according to claim 1 having a glass thickness of 0.8 to 1.2 mm.

21. A glass container according to claim 20 having a tubular shape, a diameter of 8 to 25 mm, a height of 50 to 180 mm, and a volume of 5 to 50 ml.

22. A hermetically heat-sealed container formed of the container of claim 1.

23. A container according to claim 1, wherein only said heat-sealable, open-end portion is formed of said infrared-absorbing glass.

24. A heat-sealable glass container having a tapered open-end portion formed of an infrared-absorbing glass comprising: $SiO_2$ 65–75 wt. %, $B_2O_3$ 0–3 wt. %, $Al_2O_3$ 1–5 wt. %, $Li_2O$ 0–2 wt. %, $Na_2O$ 5–12 wt. %, $K_2O$ 2–6 wt. %, BaO 5–10 wt. %, $Fe_3O_4$ 2–5 wt. %, F 0–2 wt. % and a reducing agent, said container having a breakaway area spaced from said end portion, and said breakaway area being marked for visual identification.

25. The heat-sealable glass container of claim 24, wherein the entire container is formed of said infrared-absorbing glass.

26. The heat-sealable glass container of claim 24, wherein the breakaway area has been prestressed by localized heating.

27. The heat-sealable glass container of claim 24, wherein at least two sides of the container are substantially parallel.

28. The heat-sealable glass container of claim 24, which has been heated and drawn to a point, thereby to hermetically seal the container.

29. The heat-sealable container of claim 28, wherein the sealed container has an outer continuous plastic coating.

* * * * *